United States Patent [19]

Webb, Sr.

[11] 4,275,848

[45] Jun. 30, 1981

[54] PORTABLE GARBAGE DISPOSAL UNIT

[76] Inventor: Alexander Webb, Sr., 14914 Seeley, Harvey, Ill. 60426

[21] Appl. No.: 81,813

[22] Filed: Oct. 4, 1979

[51] Int. Cl.[3] ..... B02C 18/18

[52] U.S. Cl. ..... 241/46 B; 241/152 R; 241/169.1; 241/282.1; 241/285 R

[58] Field of Search ..... 241/46 A, 46 B, 285 R, 241/169.1, 277, 282.1, 282.2, 154, 152 R

[56] References Cited

U.S. PATENT DOCUMENTS 2,594,635 4/1952 Gamaunt, Sr. ..... 241/46 A

*Primary Examiner*—Mark Rosenbaum

[57] ABSTRACT

A portable garbage disposal unit includes a one and one-half gallon container, with a water inlet neck and a garbage outlet neck. It further includes an external electric motor, which drives a multiple number of blade units on its interior, for grinding even meat bones.

1 Claim, 4 Drawing Figures

PORTABLE GARBAGE DISPOSAL UNIT

This invention relates to disintegrating devices, and more particularly, to a portable garbage disposal unit.

It is, therefore, the principal object of this invention to provide a portable garbage disposal unit, which will effectively disintegrate garbage.

Another object of this invention is to provide a portable garbage disposal unit, which will use water in the process of grinding the garbage.

A further object of this invention is to provide a portable garbage disposal unit, which will employ motor-driven blades, for grinding and mixing water with the garbage that will be discharged from the bottom of the unit.

Other objects are to provide a portable garbage disposable unit, which is simple in design, inexpensive to manufacture, rugged in construction, easy to use, and efficient in operation.

These, and other objects, will be readily evident, upon a study of the following specification, and the accompanying drawing, wherein.

Figure 1:
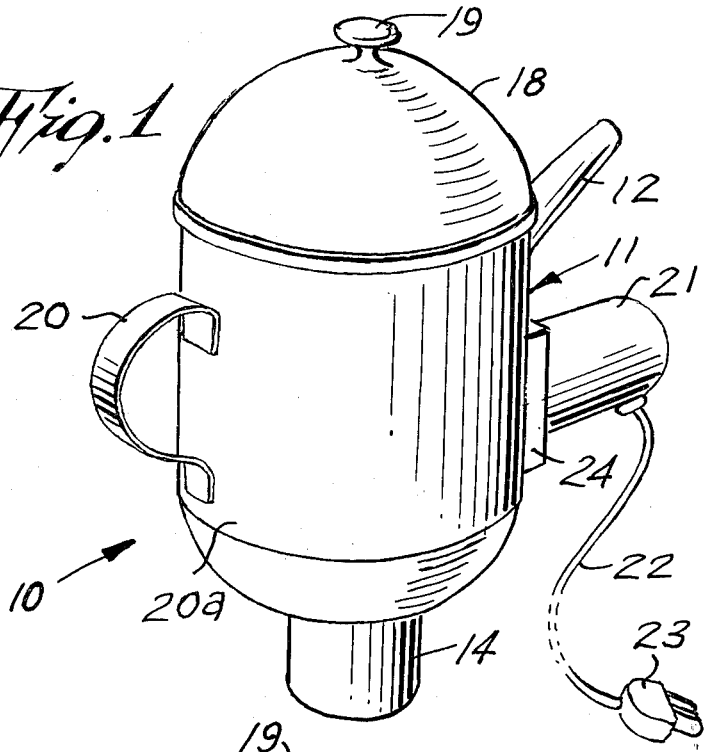
FIG. 1 is a perspective view of the present invention.

According to this invention, a unit 10 is shown to include a cylindrical container 11, of suitable material, having an upwardly extending water inlet neck 12, to which is removably secured a hose 13. On the bottom center of container 11 is a garbage discharge neck 14, which is integral of container 11, and the water and ground garbage is discharged from the opening 15. In the upper opening 15*a* of container 11 is a removable screen 16, that is lifted by means of handle 17. The cover 18 of container 11 is removed, by its handle 19, for insertion of the garbage, after the screen 16 is removed. A handle 20 is fixedly secured to the outer periphery 20*a* of container 11, for the user to carry unit 10.

An electric motor 21, having a cord 22 and a plug 23, is secured, by its flange 24, by suitable fastening means (not shown), to the outer periphery 20*a* of container 11, and motor shaft 25 includes a gear 26 rigidly secured thereto, and gear 26 engages the upper ring gears 27 by means of their teeth 27*a*. Gears 28 also engage the teeth

Figure 4:
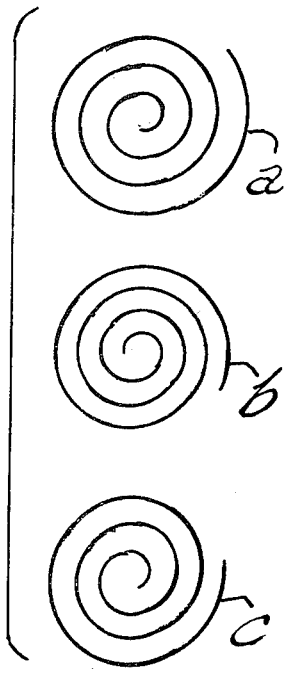
FIG. 4 is a diagrammatic plan view of the cutting blades shown in FIGS. 2 and 3.
Figure 2:
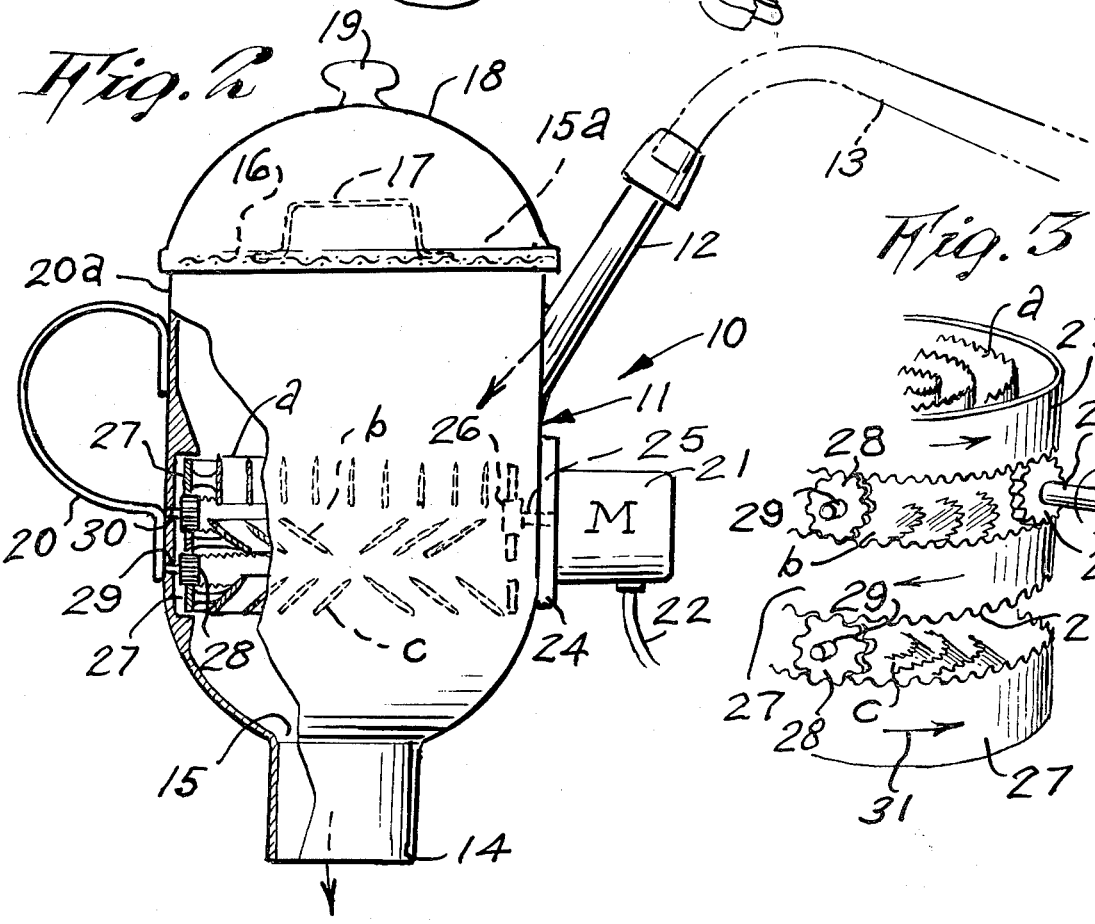
FIG. 2 is a side view of FIG. 1, shown in elevation and partly broken away, and illustrates a water hose in phantom.
Figure 3:
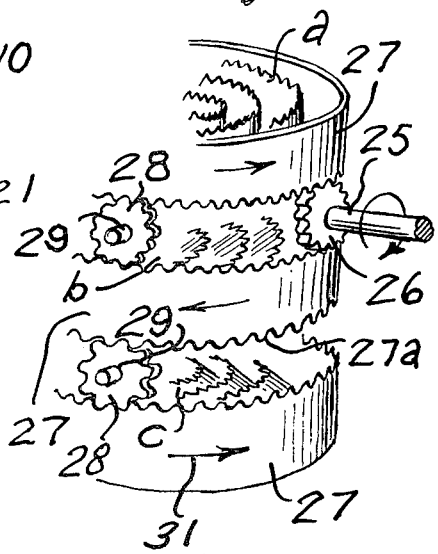
FIG. 3 is a fragmentary perspective view of the grinding mechanism of the unit, shown removed from the invention.

27*a* of ring gears 27, and their shafts 29 are rotatable in their respective openings 30, in container 11. Ring gears 27 are rotated by means of gear 26, as indicated by the arrows 31, and the toothed cutting blades a, b, and c, are spiral in configuration, and are fixedly secured, in a suitable manner, to the interiors of their respective ring gears 27, so as to grind and mix the garbage with water which will be discharged from outlet neck 14. As clearly shown, in FIGS. 2, 3 and 4, each cutter comprises a flat spiral blade, rolled into a coil; the center blade b being coiled in an opposite direction to blades a and b; the upper edges of all the blades being toothed; and, as shown in FIGS. 2 and 3, while the blade a is wound so that the blade width extends along a plane parallel to the axis, that of the blade b is centrally downwardly inclined, while that of the blade c is centrally upwardly inclined, so as to cause the garbage to turbulate thoroughly as it moves through the spiral cutters.

While various changes may be made in the detail construction, it is understood that such changes will be within the spirit and scope of the present invention, as is defined by the appended claims.

What I now claim is:

1. A portable garbage disposal unit, comprising, in combination, an upright, cylindrical container, for placement of garbage therein, so as to be ground up and mixed with water, for then being flushed outward therefrom, a carrying handle on a side of said container, an external electric motor mounted on a side of said container, a plurality of three axially aligned, spiral cutters inside said container along a central vertical axis of said container, a transmission between said motor and said cutters, for rotation of said cutters; a water intake neck, at an upper portion of said container, for delivering water down upon said cutters, a downward neck at the bottom of said container, for discharge of said water and said garbage, after being ground up on said cutters; a top opening on said container, for placement of said garbage therein, a removable cover closing said opening; and said spiral cutter comprising a spiral-shaped, flat blade, said blade of the uppermost said cutter being parallel to said container vertical axis, said blade of a lowermost said cutter being downwardly, outwardly inclined, while said blade of an intermediate said cutter is upwardly, outwardly inclined, and upper edges of said blades are toothed, a circular ring gear secured around each said cutter, and said transmission comprises gears between edges of said ring gears powered from said motor, so as to rotate said ring gears and their cutters.

* * * * *